United States Patent [19]

Denis et al.

[11] Patent Number: 4,869,842

[45] Date of Patent: Sep. 26, 1989

[54] LIQUID ABRASIVE CLEANSING COMPOSITION CONTAINING GREASE-REMOVAL SOLVENT

[75] Inventors: Jean-Pierre Denis, Thimister; Nicole Andries, Vorous-Lez-Liers; Pierre Fonsny, Fays, all of Belgium

[73] Assignee: Colgate-Palmolive Co., Piscataway, N.J.

[21] Appl. No.: 175,837

[22] Filed: Mar. 31, 1988

[51] Int. Cl.[4] ..... C11D 3/14; C11D 3/43; C11D 11/04; C11D 17/08

[52] U.S. Cl. ..... 252/121; 252/112; 252/115; 252/119; 252/122; 252/123; 252/124; 252/129; 252/131; 252/132; 252/163; 252/165; 252/168; 252/173; 252/174.13; 252/174.14; 252/174.21; 252/174.22; 252/174.24; 252/174.25; 252/358; 252/370; 252/559; 252/DIG. 14

[58] Field of Search ..... 252/112, 113, 115, 116, 252/119, 123, 124, 125, 126, 131, 154, 163, 165, 168, 174, 174.21, 174.22, 174.25, 540, 559, DIG. 14, 173

[56] References Cited

U.S. PATENT DOCUMENTS

| | | | |
|---|---|---|---|
| 3,956,158 | 5/1976 | Donaldson | 252/102 |
| 3,981,826 | 9/1976 | Munro | 252/526 |
| 4,129,423 | 12/1978 | Rubin | 51/304 |
| 4,153,570 | 5/1979 | Hennemann | 252/121 |
| 4,240,919 | 12/1980 | Chapman | 252/95 |
| 4,302,347 | 11/1981 | Straw | 252/116 |
| 4,347,151 | 8/1982 | Lohr | 252/163 |
| 4,530,775 | 7/1985 | Brierley | 252/128 |
| 4,676,920 | 6/1987 | Culshaw | 252/163 |
| 4,758,377 | 7/1988 | Iding | 252/556 |
| 4,767,563 | 8/1988 | Buzzaccarini | 252/174.25 |
| 4,767,625 | 8/1988 | Mitsuno | 424/95 |

FOREIGN PATENT DOCUMENTS

| | | | |
|---|---|---|---|
| 249140 | 1/1964 | Australia . | |
| 0126545 | 11/1984 | European Pat. Off. . | |
| 0137616 | 4/1985 | European Pat. Off. . | |
| 2148928A | 6/1985 | United Kingdom | 252/128 |
| 2178755A | 2/1987 | United Kingdom . | |

*Primary Examiner*—Dennis Albrecht

*Attorney, Agent, or Firm*—Bernard Lieberman; Robert C. Sullivan; Murray M. Grill

[57] ABSTRACT

A liquid cleansing composition, for use as a hard surface cleaner, comprises (A) a base liquid composition comprising (a) a base composition comprising:

(1) an anionic surfactant, (2) a nonionic surfactant, (3) a non-polar grease-removal solvent, (4) a water-soluble detergent builder salt, (5) optionally, a perfume, and (6) optionally, a dye; and (b) water; and (B) an abrasive.

The liquid cleansing composition is in the form of a liquid crystalline material of the smectic type. A method of making the liquid cleansing composition comprises sequential addition of the various ingredients.

31 Claims, No Drawings

LIQUID ABRASIVE CLEANSING COMPOSITION CONTAINING GREASE-REMOVAL SOLVENT

BACKGROUND OF THE INVENTION

1. Field of the Invention

The present invention is directed to a liquid cleanser composition containing a non-polar solvent and a method for making the same. More particularly, the present invention is directed to a cream scourer composition containing a non-polar, grease-removal solvent, wherein the composition is formulated as a liquid crystalline material of the smectic type.

2. Description of the Prior Art

It is well known to formulate scouring compositions, in liquid or creamy form, containing solvents.

European Patent Application No. 0 126 545, published Nov. 28, 1984, discloses creamy scouring compositions containing an abrasive and a binary solvent system comprising terpenes and polar solvents.

British Patent Application No. 2 178 755A, published Feb. 18, 1987, discloses terpene-free creamy scouring compositions wherein a binary solvent system comprising a long-chain fatty alcohol and a water-insoluble solvent (e.g. a paraffin oil or an alkyl benzene) is utilized.

U.S. Pat. No. 3,981,826, to Munro, discloses water-soluble, non-aqueous, liquid, pasty or gelatinous detergent compositions having scouring properties which comprise a dispersion in a water-miscible liquid medium of a normally-solid water-soluble anionic surface-active agent, a solid particulate water-soluble inorganic salt and a suspending agent (which thickens or confers Bingham plastic character on the composition, e.g., a highly-voluminous oxide such as silica, magnesia, alumina or clay-like substances).

U.S. Pat. No. 4,240,919, to Chapman, discloses a liquid abrasive scouring composition comprising water, an abrasive, and a multivalent metal stearate formulated as a "thixotropic" liquid.

Australian Patent No. 249,140 discloses a stable, pourable suspension of a finely-divided, water-insoluble abrasive material in a liquid medium comprising water, an anionic detergent (e.g., a soap or a synthetic anionic detergent or a mixture thereof) and a non-ionic surfactant.

U.S. Pat. No. 3,956,158, to Donaldson, discloses a pourable, liquid medium with Bingham plastic characteristics wherein the medium contains a particulate solid dispersed therein which is prevented from separating by the presence of a three-dimensional network of entangled filaments of insoluble material (e.g., asbestos, cellulose or soaps).

European Patent Application No. 0 137 616, published Apr. 17, 1985, discloses liquid detergent compositions comprising conventional detersive surfactants and other detergent ingredients together with a grease-removal solvent (e.g., terpenes, paraffin oil, alkyl aromatics, liquid olefins or mixtures thereof) and a fatty acid or soap formulated as an oil-in-water microemulsion at a pH of 6.5 or above.

SUMMARY OF THE INVENTION

It is an object of the present invention to provide a liquid cleansing composition for use as a hard surface cleaner.

It is an object of the present invention to provide a liquid cleansing composition of improved degreasing performance due to the presence of a grease-removal solvent.

It is a further object of the present invention to provide a liquid cleansing composition generating reduced foam volumes so as to make for easier rinsability.

It is a still further object of the present invention to provide a stable liquid cleansing composition wherein thickeners are not required.

It is yet a further object of the present invention to provide a process for manufacturing a stable liquid composition, with abrasives being present.

These and other objects of the invention, as will become apparent hereinafter may be achieved by the provision of:

A liquid cleanser composition comprising:

(I) about 40 to about 90 parts by weight of a base liquid composition comprising (a) about 7 to about 20 parts by weight of a base composition comprising:

(1) about 2.5 to 7.5 parts by weight of an anionic surfactant, said anionic surfactant comprising an organic hydrophobic moiety and at least one water-solubilizing salt group selected from the group consisting of sulphonate, sulphate, carboxylate, phosphonate and phosphate, (2) about 1.25 to 6.5 parts by weight of a nonionic surfactant, (3) about 1.8 to 5.4 parts by weight of a non-polar, grease-removal solvent, (4) about 1 to 5 parts by weight of a water-soluble detergent builder salt, (5) 0 to about 1 part by weight of a perfume, and (6) optionally, a dye in an amount sufficient to impart a predetermined color to said liquid cleanser composition; and (b) about 15 to about 60 parts by weight of water; and (II) about 10 to about 60 parts by weight of an insoluble abrasive;

said composition being formulated as a liquid crystalline material of the smectic type.

In a preferred embodiment of the invention, the foregoing liquid cleanser composition further comprises about 40 parts by weight of an insoluble abrasive for each about 60 parts by weight of said base liquid composition.

In a further embodiment, the present invention provides:

A method for the preparation of a liquid cleanser composition comprising:

(I) about 40 to about 90 parts by weight of a base liquid composition comprising:

(a) about 7 to about 20 parts by weight of a base composition comprising:

(1) about 2.5 to 7.5 parts by weight of an anionic surfactant, said anionic surfactant comprising an organic hydrophobic moiety and at least one water-solubilizing salt group selected from the group consisting of sulphonate, sulphate, carboxylate, phosphonate and phosphate, (2) about 1.25 to 6.5 parts by weight of a nonionic surfactant, (3) about 1.8 to 5.4 parts by weight of a non-polar, grease-removal solvent, (4) about 1 to 5 parts by weight of a water-soluble detergent builder salt, (5) 0 to about 1 part by weight of a perfume, and (6) optionally, a dye in an amount sufficient to impart a predetermined color to said liquid cleanser composition; and (b) about 15 to about 60 parts by weight of water; and (II) about 10 to about 60 parts by weight of an insoluble abrasive;

wherein said liquid cleanser composition is a liquid crystalline material of the smectic type, said method comprising:

(A) dispersing said anionic surfactant, with said water-solubilizing group in its acid form, in said water;

(B) converting said anionic surfactant, with said water-solubilizing group in its acid form, dispersed in said water, to said anionic surfactant, with said water-solubilizing in its salt form; and (C) dispersing the remaining ingredients of said liquid cleanser composition in the aqueous dispersion formed in said step (B).

In a preferred embodiment of the invention, the foregoing step (C) comprises the following sequential substeps:

(1) dispersing said nonionic surfactant in the aqueous dispersion formed in said step (B);

(2) dispersing said non-polar, grease-removal solvent in the aqueous dispersion formed in said immediately preceding subset;

(3) dispersing said insoluble abrasive in the aqueous dispersion formed in said immediately preceding substep;

(4) dispersing said water-soluble detergent builder salt in the aqueous dispersion formed in said immediately preceding substep;

(5) dispersing said dye in the aqueous dispersion formed in said immediately preceding substep; and (6) dispersing said perfume in the aqueous dispersion formed in said immediately preceding substep.

In a particularly preferred embodiment of the invention, the aforementioned process is directed to a liquid cleanser composition comprising about 40 parts by weight of an insoluble abrasive for each about 60 parts by weight of said base liquid composition.

DETAILED DESCRIPTION OF THE INVENTION

The liquid cleanser composition of the present invention comprises a base liquid composition and an insoluble abrasive, with the liquid cleanser composition being in the form of a liquid crystalline material of the smectic type, i.e. of the lamellar type wherein rod-like molecules lie parallel, their ends in line, forming layers. The layers may be curved and distorted in bulk or near solid surfaces but in thin unsupported films they are flat and layer flow may be observed, a high degree of molecular order persisting.

The insoluble abrasive is generally present in an amount of about 60 to about 10 parts by weight for each about 40 to about 90 parts by weight of the base liquid composition, preferably, about 40 arts by weight of the abrasive are mixed with about 60 parts by weight of the base liquid composition.

Suitable abrasives useful in the present invention are selected from water-insoluble, non-gritty materials well-known in the literature for their relatively mild abrasive properties. It is highly preferred that the abrasives used herein not be undesirably "scratchy". Abrasive materials having a Mohs hardness in the range of about 1 to 7 are typically used; abrasives having a Mohs hardness of 3, or below, being used to avoid scratches on aluminum or stainless steel finishes. Suitable inorganic abrasives include calcium carbonate (e.g. calcite), calcium sulfate, limestone, dolomite, diatomaceous earth, as well as materials such as Fuller's earth, magnesium carbonate, China clay, attapulgite, calcium hydroxyapatite, calcium orthophosphate and the like, or any other water-insoluble mineral salt.

Organic abrasives such as urea-formaldehyde, methyl methacrylate, and melamine-formaldehyde resins; polyethylene spheres and polyvinylchloride (PVC) can be used in order to avoid scratching on certain surfaces, especially plastic surfaces.

The "hard" inorganic abrasives can be converted to "soft" organic abrasives by coating the former with synthetic resins or a fatty acid, e.g., stearic acid, by techniques wellknown in the art.

Typically, the abrasives have a particle size range of from 5 to 1,000 microns.

The base liquid composition comprises about 7 to about 20 parts by weight of a base composition admixed with about 15 to about 60 parts by weight of water, preferably about 14 parts of the base composition are dispersed in about 45 parts of water.

The base composition, in turn, comprises (1) about 2.5 to 7.5 parts by weight of an anionic surfactant, (2) about 1.25 to 6.5 parts by weight of a nonionic surfactant, (3) about 1.8 to 5.4 parts by weight of a grease removal solvent, (4) about 1 to 5 parts by weight of a water-soluble detergent builder salt, (5) 0 to about 1 part by weight of a perfume, and (6) optionally, a dye in an amount sufficient to impart a predetermined color to said liquid cleanser composition.

Among the anionic surface active agents useful in the present invention are those surface active compounds which contain an organic hydrophobic moiety containing from about 8 to 26 carbon atoms and preferably from about 10 to 18 carbon atoms in their molecular structure and at least one water solubilizing salt group selected from the group of sulphonate, sulphate, carboxylate, phosphonate and phosphate so as to form a water-soluble surfactant.

Examples of suitable anionic surfactants include soaps, such as the water-soluble salts (e.g., the sodium, potassium, ammonium and alkanolammonium salts) of higher fatty acids or resin salts containing from about 8 to 20 carbon atoms and preferably 10 to 18 carbon atoms. Suitable fatty acids can be obtained from oils and waxes of animal or vegetable origin, for example, tallow, grease, coconut oil, palm kernel oil (also known as palm oil or palm nut oil), and mixtures thereof. Particularly useful are the sodium and potassium salts, especially the sodium salts, of the fatty acid mixtures derived from coconut oil and palm kernel oil, for example sodium coconut soap and sodium palm kernel soap.

The suitable anionic surfactants also include the water-soluble sulphated and sulphonated surface active agents having an aliphatic, preferably an alkyl, most preferably a linear alkyl, radical containing from about 8 to 26, preferably from about 10 to 22, and most preferably from about 10 to 13 carbon atoms. Preferred compounds include the sodium, potassium and ammonium salts of the linear alkyl sulphonates, especially the sodium salts. Other examples of suitable sulphonated anionic surfactants are the higher alkyl mononuclear aromatic sulphonates, such as the higher alkyl benzene sulphonates containing from about 10 to 16 carbon atoms in the higher alkyl group in a straight or branched chain, such as, for example, the sodium, potassium and ammonium salts of higher alkyl benzene sulphonates, higher alkyl toluene sulphonates and higher alkyl phenol sulphonates.

Further suitable anionic surfactants include the olefin sulphonates including long chain alkene sulphonates, long chain hydroxyalkane sulphonates or mixtures of alkene sulphonates and hydroxyalkane sulphonates. The olefin sulphonate detergents may be prepared in a conventional manner by the reaction of sulphur trioxide ($SO_3$) with long chain olefins containing from about 8 to 25, and preferably from about 12 to 21 carbon atoms, such olefins having the formula $RCH{=}CHR^1$ wherein R represents a higher alkyl group of from about 6 to 23 carbon atoms and $R^1$ represents an alkyl group containing from about 1 to 17 carbon atoms or hydrogen, to form a mixture of sultones and alkene sulphonic acids which is then treated to convert the sultones to sulphonates. Still other examples of sulphate or sulphonate surfactants are paraffin sulphonates containing from about 10 to 20 carbon atoms, and preferably from about 15 to 20 carbon atoms. Primary paraffin sulphonates are made by reacting long chain alpha-olefins and bisulfites. Paraffin sulphonates having the sulphonate group distributed along the paraffin chain are shown in U.S. Pat. Nos. 2,503,280; 4,507,088; 3,260,741; 3,372,188 and German Patent No. 735,096.

Still further examples of suitable anionic surfactants are sulphated ethoxylated higher fatty alcohols of the formula $RO(C_2H_4O)_mSO_3M$, wherein R represents a fatty alkyl group of from 10 to 18 carbon atoms, m is from 2 to 6 (preferably having a value from about 1/5 to about ½ the number of carbon atoms in the R group) and M is a solubilizing salt-forming cation, such as an alkali metal, ammonium, lower alkylamino or lower alkanolamino, or a higher alkyl benzene sulphonate wherein the higher alkyl group is of 10 to 15 carbon atoms. The proportion of ethylene oxide in the polyethoxylated higher alkanol sulphate is preferably 2 to 5 moles of ethylene oxide groups per mole of anionic surfactant, with three moles being most preferred, especially when the higher alkanol is of 11 to 15 carbon atoms. To maintain the desired hydrophile-lipophile balance (HLB), when the carbon atom content of the alkyl chain is in the lower portion of the 10 to 18 carbon atoms range, the ethylene oxide content of the surfactant may be reduced to about two moles per mole; whereas, when the higher alkanol is of 16 to 18 carbon atoms, i.e. in the higher part of the range, the number of ethylene oxide groups may be increased to 4 or 5 and in some cases to as high as 8 to 9 moles per mole. Similarly, the salt-forming cation may be altered to obtain the best solubility. It may be any suitably solubilizing metal or radical but will most frequently be an alkali metal (e.g., sodium) or ammonium. If lower alkylamine or alkanolamine groups are utilized, the alkyl groups and alkanols will usually contain from 1 to 4 carbon atoms and the amines and alkanolamines may be mono-, di- and tri-substituted, as in monoethanolamine, di-isopropanolamine and trimethylamine. An exemplary polyethoxylated alcohol sulphate detergent is available from Shell Chemical Company and is marketed as Neodol® 25-3S.

The most highly preferred water-soluble anionic surfactants are the alkali metal (e.g., soduum and potassium) salts of higher fatty acids having 10 to 18 carbon atoms, especially the sodium salts thereof, and most especially the sodium salts of fatty acid mixtures derived from coconut oil and palm kernel oil, i.e. sodium coconut soap and sodium palm kernel soap (sodium coconut-palm kernel soap); and the alkali metal (e.g., sodium and potassium) salts of linear alkyl sulphonates having 8 to 26 carbon atoms, especially the sodium salts thereof and most especially the sodium salts of linear alkyl sulphonates having 10 to 13 carbon atoms.

A particularly preferred embodiment of the present invention utilizes a mixture of about 3 to about 4 parts by weight of the sodium salt of a linear alkyl sulphonate having 10 to 13 carbon atoms (NaLAS) and about 1 to about 2 parts by weight of sodium coconut-palm kernel soap (NaCPKS), preferably, about 3.5 to about 4 parts by weight of NaLAS and about 1 to about 1.5 parts by weight of NaCPKS, and, most preferably, 3.7 parts by weight of NaLAS and 1.3 parts by weight of NaCPKS.

The nonionic surface active agents useful in the present invention are characterized by the presence of an organic hydrophobic and an organic hydrophilic group and are typically produced by the condensation of an organic aliphatic or alkyl aromatic hydrophobic compound with ethylene oxide (which is hydrophilic in nature). Practically any hydrophobic compound having a carboxy, hydroxy, amido or amino group with a free hydrogen attached to the nitrogen can be condensed with ethylene oxide or with the polyhydration product thereof, i.e. polyethylene glycol, to form a nonionic surfactant. The length of the hydrophilic (polyoxyethylene) chain can be readily adjusted to achieve the desired balance between the hydrophobic and hydrophilic groups.

The nonionic surfactant employed is preferably a poly-lower-alkoxylated higher alkanol wherein the alkanol has 8 to 22 carbon atoms, preferably 8 to 18 carbon atoms, most preferably 9 to 15 carbon atoms; and wherein the number of moles of lower alkylene oxide (of 2 or 3 carbon atoms) is from 2 to 20, preferably 2 to 10, most preferably 2 to 6. Of such materials, it is preferred to employ those wherein the higher alkanol is a higher fatty alcohol of 9 to 15 carbon atoms and which contain from 3 to 6 lower alkoxy groups per mole; or a mixture of compounds wherein the higher alkanol is a higher fatty alcohol of about 16 to 18 carbon atoms and which contain from 5 to 7 lower alkoxy groups per mole and compounds wherein the higher alkanol is a higher fatty alcohol of about 9 to 12 carbon atoms and which contain from 2 to 4 lower alkoxy groups per mole. Most preferably, there is employed a 50-50 mixture (by weight) of compounds wherein the higher alkanol is a higher fatty alcohol of 9 to 11 carbon atoms and which contain 2.5 lower alkoxy groups per mole and compounds wherein the higher alkanol is a higher fatty alcohol of 16 to 18 carbon atoms and which contain 6 lower alkoxy groups per mole.

Exemplary of the aforementioned nonionic surfactants are Neodol® 25-7 and Neodol® 23-6.5 (products of Shell), the former being a condensation product of a mixture of about 1 mole of a higher fatty alcohols averaging about 12 to 15 carbon atoms with about 7 moles of ethylene oxide, and the latter being a condensation product of about 1 mole of a mixture of higher fatty alcohols averaging about 12 to 13 carbon atoms with about 6.5 moles of ethylene oxide, wherein the higher alcohols are primary alcohols. Other examples of such nonionic surfactants are Tergitol® 15-2-7 and Tergitol® 15-S-9 (products of Union Carbide), both of which are linear secondary alcohol ethoxylates. The former is a condensation product of about 1 mole of a mixture of secondary higher fatty alcohols averaging 11 to 15 carbon atoms with about 7 moles of ethylene oxide, and the latter is a condensation product of about 1 mole of a mixture of secondary higher fatty alcohols averaging 11 to 15 carbon atoms with about 9 moles of ethylene oxide.

Highly preferred nonionics useful in the present invention, which are similar ethylene oxide condensation products of mixtures of primary higher fatty alcohols include: Dobanol® 91-5 (Shell), higher fatty alcohols averaging 9 to 11 carbons and 5 moles of ethylene oxide; Dobanol® 91-2.5 (Shell), higher fatty alcohols averaging 9 to 11 carbons and 2.5 moles of ethylene oxide; Dobanol 45.4 (Shell), higher fatty alcohols averaging 14 to 15 carbons and 4 moles of ethylene oxide; Nacolox® 810-30 (Condea), higher fatty alcohols averaging 8 to 10 carbons and 3 moles of ethylene oxide; Nacolox® 1012-30 (Condea), higher fatty alcohols averaging 10 to 12 carbons and 3 moles of ethylene oxide; Dobanol 25-3 (Shell), higher fatty alcohols averaging 12 to 15 carbons and 3 moles of ethylene oxide; Aeropol 35-7 (Exxon), higher fatty alcohols averaging 13 to 15 carbons and 7 moles of ethylene oxide; Aeropol 91-3 (Exxon), higher fatty alcohols averaging 9 to 11 carbons and 3 moles of ethylene oxide; and Nacolox® 1618-60 (Condea), higher fatty alcohols averaging 16 to 18 carbons and 6 moles of ethylene oxide.

Suitable non-polar, grease-removal solvents useful in the present invention are substantially water-insoluble, i.e. they have a solubility in water of less than about 5% by weight. Suitable solvents include hydrocarbon solvents which are noncyclic, and especially saturated, non-cyclic hydrocarbons. Preferred solvents include the $C_8$–$C_{20}$ paraffin oils and especially the $C_{10}$–$C_{12}$ isoparaffins, commercially available as Shellsol. T (Shell), and the $C_9$–$C_{11}$ isoparaffins, commercially available as Isopar® H (Exxon).

Alternatively, oxygenated hydrocarbons can be utilized in lieu of the non-polar, grease-removal solvent. Suitable oxygenated hydrocarbons include dibenzylether, hexyl acetate, hexanol or mixtures thereof.

When the solvent is one of the aforementioned oxygenated hydrocarbons, a fatty alcohol of 8 to 20 carbon atoms, preferably 8 to 10 carbon atoms, e.g., decanol, octanol or a mixture thereof may be included in the base composition in an amount of 0 to about 0.5 part by weight.

The compositions of the invention contain at least one builder salt of the type commonly used in detergent formulations. Useful builders include any of the conventional inorganic water-soluble builder salts, such as, for example, water-soluble salts of phosphates, pyrophosphates, orthophosphates, polyphosphates, tripolyphosphates, silicates, carbonates, bicarbonates, borates, sulfates, and the like. Organic builders include water-soluble phosphonates, polyphosphonates, polyhydroxysulphonates, polyacetates, aminopolyacetates, carboxylates, polycarboxylates, succinates, phytates, and the like.

Specific examples of inorganic phosphate builders include sodium and potassium tripolyphosphates, pyrophosphates and hexametaphosphates. The organic polyphosphonates specifically include, for example, the sodium and potassium salts of ethane 1-hydroxy-1,1-diphosphonic acid and the sodium and potassium salts of ethane-1,1,2-triphosphonic acid. Examples of these and other phosphorous builder compounds are disclosed in U.S. Pat. Nos. 3,213,030; 2,422,021; 3,422,137 and 3,400,176.

Specific examples of non-phosphorous inorganic builders include water-soluble inorganic carbonate, bicarbonate and silicate salts. The alkali metal, for example, sodium and potassium, carbonates, bicarbonates and silicates are particularly useful herein, especially sodium carbonate, sodium bicarbonate or mixtures thereof.

Water-soluble organic builders are also useful. For example, the alkali metal, ammonium and substituted ammonium acetates, carboxylates, polycarboxylates and polyhydroxysulphonates are useful builders for the compositions and processes of the present invention. Specific examples of acetate and polycarboxylate builders include sodium, potassium, lithium, ammonium and substituted ammonium salts of ethylene diaminetetracetic acid, nitrilotriacetic acid, benzene polycarboxylic (i.e. penta- and tetra-)acids, carboxymethoxysuccinic acid and citric acid.

Additional organic builder salts useful herein include the polycarboxylate materials described in U.S. Pat. No. 2,264,103, including the water-soluble alkali metal salts of mellitic acid. The water-soluble salts of polycarboxylate polymers and copolymers such as are described in U.S. Pat. No. 3,308,067, are also suitable herein.

Mixtures of organic and/or inorganic builders can be used herein. One such mixture of builders is disclosed in Canadian Patent No. 755,038, e.g. a ternary mixture of sodium tripolyphosphate, trisodium nitrilotriacetate and trisodium ethane-1-hydroxy-1,1-diphosphonate. It is to be understood that while the alkali metal salts of the foregoing inorganic and organic polyvalent anionic builder salts are preferred for use herein from an economic standpoint, the ammonium, alkanol ammonium, e.g. triethanol ammonium, diethanol ammonium, and the like, water-soluble salts of any of the foregoing builder anions are useful herein.

Preferably, the water-soluble builder salts are neutral or alkaline when dissolved in water, i.e. the pH is about 7 or higher, especially the sodium salts.

Perfumes, as are conventional in the art, may be added to the base composition in an amount of 0 to about 1 part by weight.

Dyes, which are also conventional in the art, may be optionally added to the base composition in an amount sufficient to impart a predetermined color to the liquid cleanser composition.

A preservative, in an amount effective to prevent degradation of the liquid cleanser composition, may optionally be incorporated in the base composition. Suitable preservatives include formaldehyde, THHT®, and Bronidox®.

In order to formulate the aforementioned liquid cleanser composition in the form of a liquid crystalline material of the smectic type, it is preferred to form the anionic surfactant, with its water-solubilizing group in the salt form, in-situ, by neutralization of the anionic surfactant, with its water-solubilizing group in the acid form. Preferably, neutralization is achieved by contact of the anionic surfactant, in its acid form, with an alkali metal hydroxide.

After in-situ formation of the anionic surfactant, in its salt form, the remaining ingredients may be incorporated in the aqueous dispersion. Preferably, the remaining ingredients are added in a predetermined sequential order. In particular, the ingredients are added in the following order:

the anionic surfactants are dispersed in water and neutralized with caustic soda;

preferably, 90% of the required caustic soda is added to the water first;

then follow, the nonionic, the fatty alcohol when present, the solvent, the abrasive, the builder salts, the dye(s) and the perfume;

optionally, the builder and/or the abrasive are added to the water first;

a polymer, e.g., a maleic acid/isobutylene sodium salt copolymer, may be added, after the builders, in an amount of 0 to about 1 part by weight, to act as a viscosity regulator by aiding dispersion of the abrasive; and the preservative is added last.

The so-prepared compositions provide superior cleaning on greasy and particulate soils, especially on hard surfaces. The scratching of delicate surfaces is reduced greatly when the preferred coated abrasive is used, and the amount of foam generated is very low making for easier and more convenient rinsing. A thickener is not required since the lamellar liquid crystal phase ensures adequate viscosity and stability. Moreover, the so-prepared compositions remain stable even though they contain relatively high levels of grease-removal solvent.

The following examples are illustrative of the present invention, and not intended as any limitation thereon.

EXAMPLES

The compositions set forth in Table I were prepared by sequential dispersion, in the order appearing in the Table. The compositions yielded a product in the form of a liquid crystalline material of the smectic type which was stable at temperatures ranging from 43° C. to 4° C. over prolonged standing.

TABLE I

| Ingredients | Brand | Supplier | 1 | 2 | 3 | 4 | 5 |
|---|---|---|---|---|---|---|---|
| Water | | | | | balance to 100 | | |
| Caustic soda | | | | | Neutralizing Amount(1) | | |
| Coco fatty acid | Radiacid 620 | Oleofina | 1.32 | 1.11 | 1.20 | 1.20 | 1.20 |
| or | | | | | | | |
| Coco palm-Kernel fatty acid | Kortacid C50 | AKZO | | | | | |
| LAS (C10-C13) | | Marchon | 3.72 | 3.173 | 3.453 | 3.453 | 3.453 |
| Nonionic | Dobanol 91-5 | Shell | 1.8 | 1.58 | — | — | — |
| | Dobanol 91-2.5 | Shell | — | — | 1.5 | — | 1.5 |
| | Dobanol 45.4 | Shell | — | — | — | 3.1 | — |
| | Nacolox 810-30 | Condea | — | — | — | — | — |
| | Nacolox 1012-30 | Condea | — | — | — | — | — |
| | Nacolox 1618-60 | Condea | — | — | 1.55 | — | 1.55 |
| n-Decanol | Nacol 10 | Condea | 0.2 | 0.17 | — | — | — |
| Hexyl acetate | | | 2 | — | — | — | — |
| Iso paraffin | Isopar H | Exxon | — | — | 3.55 | 3.55 | 3.55 |
| Dibenzyl ether | | | — | 3 | | | |
| Calcite | Durcal 40 | Omya | 50 | 45 | 40 | 40 | 55 |
| $Na_2CO_3$ | | Solvay | 1 | 3 | 2 | 2.25 | 2 |
| Maleic acid/ isobutylene sodium salt copolymer | Geropon | Geronazzo | — | — | — | — | 0.5 |
| Perfume/dye/ preservative | | | | | Optional | | |

(1)In an amount sufficient to neutralize the coco fatty acid/coco palm-kernel fatty acid and linear alkyl sulphonate of 10-13 carbons (LAS(C10-C13))

What we claim is:

1. A method for the preparation of a liquid crystalline material of the smectic type, useful as a liquid cleanser, consisting essentially of (I) about 40 to about 90 parts by weight of a base liquid composition of (a) about 7 to about 20 parts by weight of a base composition of (1) about 2.5 to 7.5 parts by weight of an anionic surfactant, said anionic surfactant comprising an organic hydrophobic moiety and at least one water-solubilizing salt group selected from the group consisting of sulphonate, sulphate, carboxylate, phosphonate and phosphate, (2) about 1.25 to 6.5 parts by weight of a nonionic surfactant, (3) about 1.8 to 5.4 parts by weight of a non-polar grease-removal solvent selected from non-cyclic, saturated hydrocarbons, (4) about 1 to 5 parts weight of a water-soluble detergent builder salt, (5) 0 to about 1 part by weight of a perfume, (6) optionally, a dye in an amount sufficient to impart a predetermined color to said liquid cleanser composition, (7) optionally, a preservative in an amount effective to prevent degradation of said liquid cleanser composition, and (8) 0 to 1 part by weight of a maleic acid/isobutylene sodium salt copolymer; and (b) about 15 to about 60 parts by weight of water; and (II) about 10 to to about 60 parts by weight of an insoluble abrasive;

said method comprising:

(A) dispersing said anionic surfactant, with said water-solubilizing group in its acid form, in said water;

(B) converting said anionic surfactant, with said water-solubilizing group in its acid form, dispersed in said water, to said anionic surfactant, with said water-solubilizing group in its salt form; and (C) dispersing the remaining ingredients of said liquid cleanser composition in the aqueous dispersion formed in said step (B).

2. The method according to claim 1 wherein said abrasive is admixed with said water prior to step A.

3. The method according to claim 1 wherein said abrasive and said water-soluble detergent builder salt are admixed with said water prior to step (A).

4. The method according to claim 1 wherein said water-soluble detergent builder salt is admixed with said water prior to step (A).

5. The method according to claim 1 wherein said step (C) comprises the following sequential substeps:

(1) dispersing said nonionic surfactant in the aqueous dispersion formed in said step (B);

(2) dispersing said non-polar grease-removal solvent in the aqueous dispersion formed in said immediately preceding substep;

(3) dispersing said insoluble abrasive in the aqueous dispersion formed in said immediately preceding substep;

(4) dispersing said water-soluble detergent builder salt in the aqueous dispersion formed in said immediately preceding substep;

(5) dispersing said dye in the aqueous dispersion formed in said immediately preceding substep; and (6) dispersing said perfume in the aqueous dispersion formed in said immediately preceding substep.

6. The method according to claim 5 wherein said step (C) comprises a further sequential substep (4a), intermediate said substeps (4) and (5), said substep (4a) comprising dispersing said maleic acid/isobutylene sodium salt copolymer in the aqueous dispersion formed in said immediately preceding substep.

7. The method according to claim 5 wherein said step (C) comprises a further sequential substep (7), following said substep (6), said substep (7) comprising dispersing said preservative in the aqueous dispersion formed in said immediately preceding substep.

8. The method according to claim 5 wherein said liquid cleanser composition comprises about 40 parts by weight of an insoluble abrasive for each about 60 parts by weight of said base liquid composition.

9. The method according to claim 5 wherein said abrasive comprises calcite coated with a fatty acid.

10. The method according to claim 9 wherein said abrasive comprises calcite coated with stearic acid.

11. The method according to claim 5 wherein said liquid cleanser composition further comprises about 40 parts by weight of an insoluble abrasive for each about 60 parts by weight of said base liquid composition, and wherein said abrasive is admixed with said water prior to step (A).

12. The method according to claim 1, wherein said step (B) comprises contacting said anionic surfactant, with said water-solubilizing group in its acid form, with an alkali metal hydroxide to substantially completely neutralize said acid-form anionic surfactant.

13. The method according to claim 12, wherein said water in step (A) contains about 90% of the alkali metal hydroxide necessary to completely neutralize said acid-form anionic surfactant.

14. The method according to claim 13, wherein said alkali metal hydroxide is sodium hydroxide.

15. The method according to claim 1 wherein said anionic surfactant comprises an alkali metal salt of a higher fatty acid having 10 to 18 carbon atoms.

16. The method according to claim 15 wherein said anionic surfactant comprises sodium coconut-palm kernel soap.

17. The method according to claim 1 wherein said anionic surfactant comprises an alkali metal salt of a linear alkyl sulphonate having 8 to 26 carbon atoms.

18. The method according to claim 17, wherein said anionic surfactant comprises the sodium salt of a linear alkyl sulphonate having 10 to 13 carbon atoms.

19. The method according to claim 1 wherein said anionic surfactant comprises a mixture of sodium coconut-palm kernel soap and a sodium salt of a linear alkyl sulphonate having 10 to 13 carbon atoms.

20. The method according to claim 1, wherein said anionic surfactant comprises a poly-loweralkoxylated higher alkanol wherein the alkanol has 8 to 22 carbon atoms and the number of moles of lower alkylene oxide per mole of alkanol is from 2 to 20.

21. The method according to claim 20, wherein said alkanol has 9 to 15 carbons and said number of moles of alkylene oxide per mole of alkanol is from 3 to 6.

22. The method according to claim 21, wherein said alkylene oxide is ethylene oxide.

23. The method according to claim 20, wherein said nonionic surfactant comprises a mixture of compounds wherein said alkanol has 16 to 18 carbons and said number of moles of alkylene oxide per mole of alkanol is from 5 to 7, and compounds wherein said alkanol has 9 to 12 carbon atoms and said number of moles of alkylene oxide per mole of alkanol is from 2 to 4.

24. The method according to claim 23, wherein said mixture comprises 50% by weight of compounds wherein the alkanol has 9 to 11 carbon atoms and said number of moles of alkylene oxide per mole of alkanol is 2.5 and 50% by weight of compounds wherein the alkanol has 16 to 18 carbons and said number of moles of alkylene oxide per mole of alkanol is 6.

25. The method according to claim 24, wherein said alkylene oxide is ethylene oxide.

26. The method according to claim 1, wherein said non-cyclic, saturated hydrocarbon is a paraffin oil of 8 to 20 carbon atoms.

27. The method according to claim 26, wherein said paraffin oil is an isoparaffin of 9 to 11 carbon atoms.

28. The method according to claim 1, wherein said water-soluble detergent builder salt comprises a neutral or alkaline sodium salt.

29. The method according to claim 28, wherein said neutral or alkaline sodium salt comprises sodium carbonate, sodium bicarbonate or a mixture thereof.

30. The method according to claim 1 wherein said liquid cleanser composition comprises about 40 parts by weight of said insoluble abrasive for each about 60 parts by weight of said base liquid composition.

31. The method according to claim 1, wherein said base liquid composition comprises (a) about 14 parts by weight of said base composition; and (b) about 45 parts by weight of water.

* * * * *